United States Patent [19]

Columbus

[11] 4,347,875

[45] Sep. 7, 1982

[54] SELF-CLEANING NOZZLE CONSTRUCTION FOR ASPIRATORS

[75] Inventor: Richard L. Columbus, Rochester, N.Y.

[73] Assignee: Eastman Kodak Company, Rochester, N.Y.

[21] Appl. No.: 168,789

[22] Filed: Jul. 14, 1980

[51] Int. Cl.[3] ..... B65B 3/04

[52] U.S. Cl. ..... 141/18; 141/67; 141/311 A; 141/392; 73/864.11; 222/108

[58] Field of Search ..... 222/108–111, 222/386, 420–422; 141/86–93, 115–127, 311 A, 18–27, 2, 392, 67, 130; 73/425, 425.4 R, 425.4 P, 425.6; 128/218 A, 218 C; 23/230 R

[56] References Cited

U.S. PATENT DOCUMENTS

| | | | |
|---|---|---|---|
| 3,494,201 | 2/1970 | Roach | 73/425.6 |
| 3,500,689 | 3/1970 | Band . | |
| 3,713,775 | 1/1973 | Schmitz . | |
| 3,732,734 | 5/1973 | Avakian et al. | 73/425.6 |
| 3,757,585 | 9/1973 | Heller et al. | 73/425.6 |
| 3,766,785 | 10/1973 | Smernoff et al. | 73/425.6 |
| 3,832,135 | 8/1974 | Drozdowski et al. | 23/230 R |
| 4,023,716 | 5/1977 | Shapiro | 73/425.6 |
| 4,072,330 | 2/1978 | Brysch . | |
| 4,237,095 | 12/1980 | Suovaniemi . | |

*Primary Examiner*—Houston S. Bell, Jr.
*Attorney, Agent, or Firm*—Dana M. Schmidt

[57] ABSTRACT

There is disclosed a nozzle for aspirating and precision dispensing liquid, the nozzle being designed to influence liquid remaining on the exterior of the nozzle after aspiration, to move away from the vicinity of the dispensing portion of the nozzle. Optionally the nozzle is part of a disposable container that includes a compartment for storing the liquid that is aspirated and subsequently dispensed.

18 Claims, 10 Drawing Figures

FIG. 6
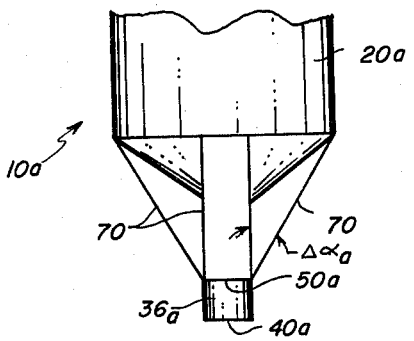
FIG. 7
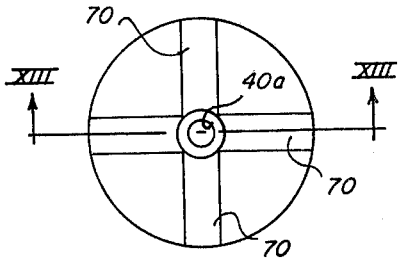
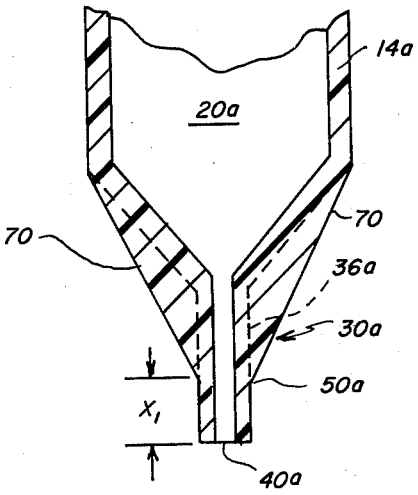
FIG. 8
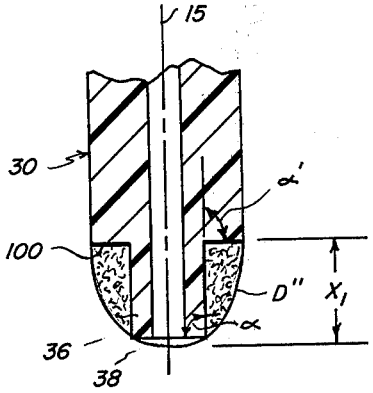
FIG. 10
COMPARATIVE EXAMPLE
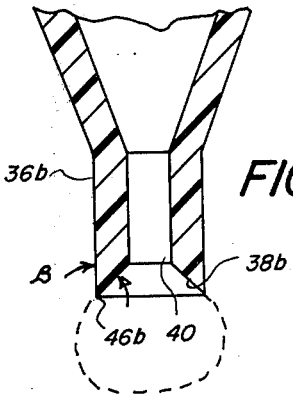
FIG. 9

SELF-CLEANING NOZZLE CONSTRUCTION FOR ASPIRATORS

FIELD OF THE INVENTION

This invention is directed to aspirator probes, and especially the construction of the nozzles therefor that are inserted into a body of liquid during aspiration and then moved to a dispensing station.

BACKGROUND OF THE INVENTION

A common method for dispensing sample liquid onto a test element for analysis is by aspiration and then by pressurized dispensing. That is, an aspirator probe is immersed into a sample liquid held in a suitable container. A partial vacuum is produced in the probe in an amount sufficient to draw up into the probe through its nozzle the required amount of liquid, and the probe is withdrawn to a station holding the test element. At that station, pressure is applied to the interior of the probe in an amount sufficient to dispense the desired amount of sample liquid out of the nozzle. To prevent cross-contamination between samples, the probe conventionally is provided with a removable and disposable "nozzle-container" which is the sole portion of the probe to contact the sample liquid.

Examples of such probes and nozzle-containers are described, e.g., in U.S. Pat. No. 3,832,135.

Conventional aspirator nozzles suffer the disadvantage that sample liquid tends to remain on the exterior surface of the nozzle when the probe is withdrawn after aspiration. Such remaining liquid interferes with subsequent dispensing if it collects in the immediate vicinity of the dispensing orifice of the nozzle. The reason is that the probe is designed to accurately dispense a predicted volume of sample liquid. Any liquid on the exterior surface of the nozzle at the orifice might also be dispensed. Alternatively, the presence of the liquid at the exterior surface might cause the dispensed quantity of liquid to perfuse up the exterior surface, rather than to move into or onto a test element. In either case, the volume of sample liquid received by the test element is altered in an unpredictable fashion.

One solution might seem to be to use a material for the exterior surface of the nozzle that is not wettable by the liquid to be dispensed. In the case of blood serum dispensing, such a material is not known to exist, due to the low contact angle of serum on the wetted surface.

Prior to this invention the problem has been dealt with by wiping the nozzle after aspiration. However, wiping means become, at worst, a potential source of contamination, and at best involve additional automated mechanisms that lower the throughput rate and increase the expense of the analyzer.

What has been desired then is an aspirator dispensing device, that eliminates the wiping heretofore needed while at the same time insures accurate volumes of dispensed sample liquid.

SUMMARY OF THE INVENTION

This invention is based on the discovery of means for causing liquid remaining behind on the exterior surface of the nozzle to automatically locate itself other than at the aspirating and dispensing orifice. In this sense, the nozzle is self-cleaning. More specifically, there is provided a nozzle for sequentially aspirating and dispensing liquid, the nozzle comprising a liquid-confining wall extending about a longitudinal axis and terminating in a liquid-dispensing orifice, the wall further including an interior surface, and an exterior surface having a portion adjacent to the aperture that is adapted to be immersed into a source of the liquid during aspiration. Further, the wall includes means for attracting liquid remaining on the adjacent exterior surface portion after aspiration, to loci spaced from the orifice a predetermined distance that is effective to prevent liquid remaining on the exterior surface from interfering with the dispensing of the liquid.

Optionally, the nozzle is part of a container that further includes a compartment having a storage capacity for the total liquid to be aspirated.

Thus, a primary advantage of the invention is that the nozzle is capable of delivering the predicted volume of liquid without errors introduced by liquid on the exterior surface of the container.

A related advantage of the invention is that the nozzle insures that liquid dispensed therefrom will not perfuse up the exterior surface away from the intended place of deposit.

Other features and advantages will become apparent from reference to the following Description of the Preferred Embodiments when read in light of the attached drawings.

BRIEF DESCRIPTION OF THE DRAWINGS

FIG. 6 is a fragmentary elevational view of an alternate embodiment of the invention;

FIG. 7 is a bottom-end view of the nozzle of FIG. 6;

FIG. 8 is a fragmentary section view taken generally along the line VIII—VIII of FIG. 7;

FIG. 9 is a section view similar to that of FIG. 2, but illustrating yet another embodiment; and FIG. 10 is a section view similar to that of FIGS. 2 and 9, but illustrating an unsatisfactory comparative example.

DESCRIPTION OF THE PREFERRED EMBODIMENTS

The nozzle of the invention is hereinafter described for use with blood serum as the preferred dispensed liquid. In addition, other liquids are aspiratable and subsequently dispensable using this invention, including other biological liquids and industrial liquids.

The preferred form of the invention hereinafter described features a removable probe container that includes the nozzle. In addition the invention can be applied to a one-piece aspirator probe device constructed in the manner hereinafter described, wherein the nozzle is not removable or identifiable as a container separate from the rest of the probe. In the latter case, the portion of the probe that functions to contain the liquid can be adjacent to or spaced from the nozzle.

The terms "top", "bottom", "above" and the like as used herein refer to relative positions occupied during the preferred use of the invention.

Figure 1:
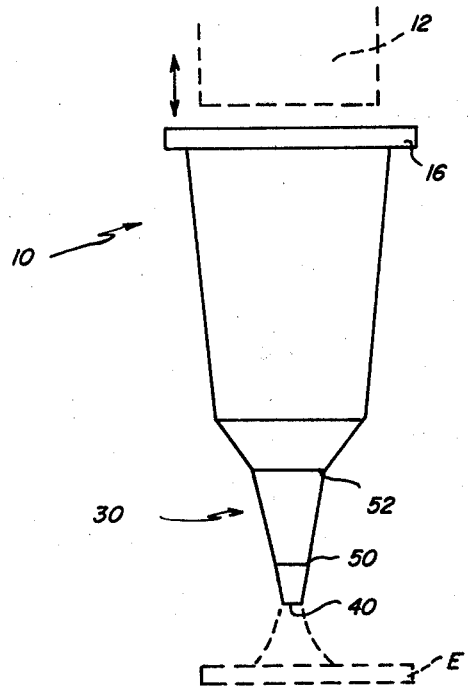
FIG. 1 is an elevational view of a nozzle constructed in accordance with the invention, showing in phantom certain related elements.

As noted, the nozzle of the invention is adapted for use as a disposable portion of an aspirator probe. In the embodiment of FIG. 1, there is provided a container 10 dimensioned to slidably fit over a probe 12 having an external diameter that accommodates the internal diameter of wall 14 of container 10, FIG. 2, that is wrapped around axis 15. A lip 16 is conveniently provided at the top of wall 14 for ease in handling. Any properly dimensioned aspirating and dispensing probe 12 is useful to accommodate container 10.

Wall 14 provides a compartment 20 for holding the total liquid amount that is to be aspirated and dispensed. A wide range of volumes is useful; 0.001 to about 1.0 ml being preferred. The compartment is open at the top portion provided with lip 16, and terminates at the opposite bottom portion in a nozzle 30.

In accord with one aspect of the invention, nozzle 30 in turn is formed by conical extensions 32, 34 and 36 of wall 14, and terminates in a dispensing orifice 40. Optionally nozzle 30 terminates at a flat platform surface 38. Conical portions 32, 34 and 36 of nozzle 30 have an exterior surface 42 and an interior surface 44. Such exterior surface at nozzle portion 36 forms an edge of intersection 46 with platform surface 38.

Figure 2:
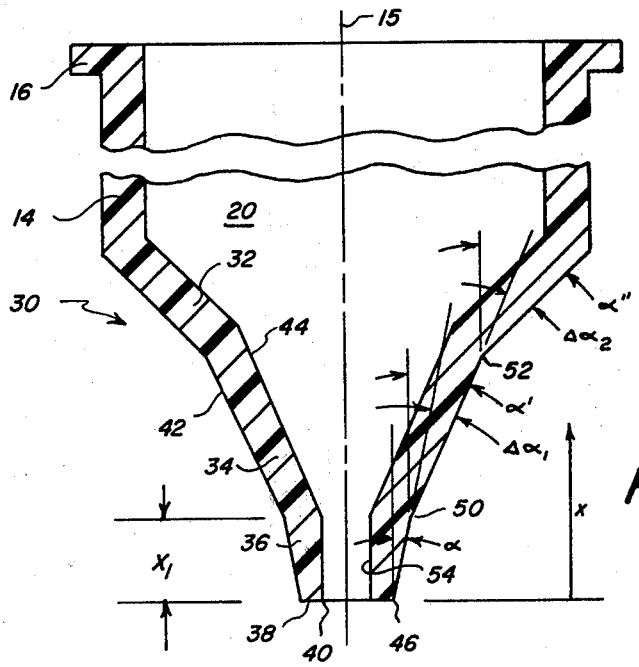
FIG. 2 is an enlarged fragmentary section view taken axially through the nozzle of FIG. 1.

Exterior surface 42 at portion 36 forms an angle $\alpha$, when seen in axial cross-section, FIG. 2, to the axis 15. A variety of values can be used for this angle, so that it is not considered to be critical. Preferably it does not exceed about 15°, and most preferably it is about 0° as shown in FIG. 9 so that portion 36 is cylindrical and parallels axis 15. It is further preferred that angle $\alpha$ be non-negative so that portion 36 is not an inverse cone, as such a design tends to inhibit the release of liquid from surface 42 as the container is withdrawn.

In accordance with another aspect of the invention, to provide the liquid attraction means of the invention that draws liquid away from orifice 40, conical portion 34 of the nozzle connects to portion 36 at a line of intersection 50 in surface 42 located a distance "$x_1$" from orifice 40. Surface 42 at portion 34 forms an included angle $\alpha'$ with axis 15 that exceeds angle alpha of portion 36 by a value $\Delta\alpha_1$. The significance of the value of $\Delta\alpha_1$ is that the effective circumferences of portion 34 increase with increasing distance from the platform, and at a rate that is significantly greater than the rate of increase, if any, present in the circumferences of surface portion 36 located between line 50 and orifice 40. It is this increase in value of the included angle, and the resulting significantly greater rate of increase in the circumferences of surface portion 34, that attracts the liquid, as is described further hereinafter. The value $\Delta\alpha_1$ can be varied depending upon the nature of the liquid being dispensed. In the case of blood serum and comparable other liquids, $\Delta\alpha_1$ is preferably between about 5° and about 60°. A "significantly greater rate" of circumference increase results when the difference angle $\Delta\alpha_1$ is at least 5°. Values of $\Delta\alpha_1$ that are greater than about 60° are unsatisfactory as they begin to approach the condition described hereinafter concerning the device of FIG. 10.

As is apparent from FIG. 2, conical portion 32 of nozzle 30 also intersects, at line 52, conical portion 34 to form an included angle $\alpha''$ with axis 15. Such angle exceeds the included angle formed by portion 34 with axis 15, by a value $\Delta\alpha_2$. The value of $\Delta\alpha_2$ is not critical, and indeed can be zero or together with angles $\alpha$ and $\Delta\alpha_1$ can provide a total included angle of 90°, if desired. However, if intersection line 52 is located within the hereinafter-described range for "$x_1$", then portion 32 acts to provide secondary loci for attraction of liquid. In other words, more than one change in angle can be advantageously utilized. If $\Delta\alpha_2$ is to function to provide additional loci of attraction for the liquid, the value of $\alpha''$ should not exceed about 60°.

Interior surface 44 also comprises the surface of cones of changing angles, culminating in a narrow-most neck portion 54. The rate at which the diameter of surface 44 decreases is not critical, nor is the diameter of portion 54. Preferably, however, the diameter of portion 54 is at least about 0.35 mm to avoid plugging.

Figure 5:
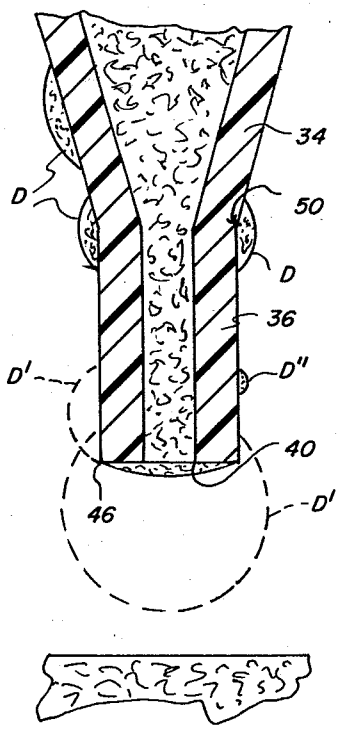
FIGS. 3–5 are fragmentary, generalized section views similar to that of FIG. 2, illustrating the use of the nozzle.
Figure 4:
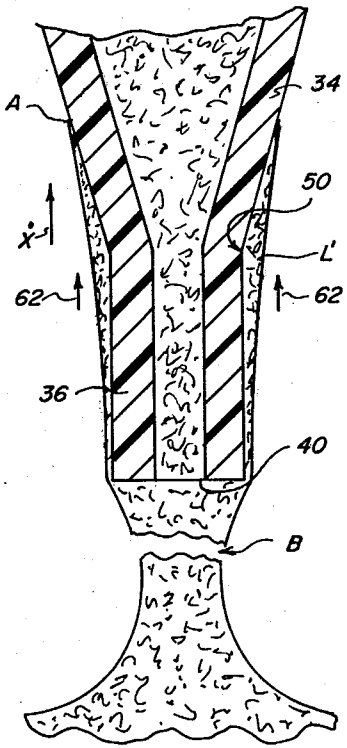
Figure 3:
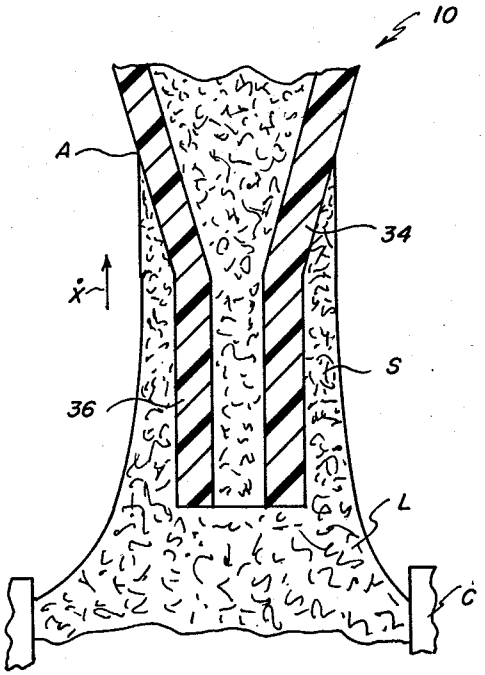

The manner in which nozzle portions 34 and 36 function to localize surface liquid away from orifice 40 is best seen in the somewhat generalized presentation of FIGS. 3–5. Container 10 is inserted into a body of liquid so that the nozzle is wetted up to point A, FIG. 3. The probe is then placed under a partial vacuum to draw liquid into compartment 20. Minimal care is required to terminate the vacuum before the liquid contacts other parts of the probe 12, FIG. 1, thereby avoiding contamination. The step of drawing liquid into container 10 is the step preceding that shown in FIG. 3.

Thereafter, the nozzle of container 10 is drawn out of a container (C) holding the liquid, FIG. 3, preferably in a vertical direction at a velocity x. As this occurs, liquid L tends to cause a sheath of liquid S to cling to nozzle 30 as it wets surface 42, at both portions 34 and 36. Eventually, the tensile strength of the liquid is reached, FIG. 4, and the sheath breaks at breakpoint B, below orifice 40. There is thus left a quantity of liquid L' on nozzle portions 34 and 36. The presence of an increased angle portion 34 extending from line of intersection 50, and ever-increasing surface areas for this portion, act as a locus of attraction for this liquid L', so that it migrates thereto, arrows 62. Very quickly the liquid coaleses into one or more major drops D attached at or above line 50, FIG. 5, away from orifice 40, rather than as a large drop D', at edge 46 of platform 38 or enveloping the platform shown in phantom. Drops at or above line 50 do not affect subsequent dispensing under pressure of the liquid onto a test element E, shown in phantom, FIG. 1. However, drops D' either create a substantial volumetric error in subsequent dispensing, or cause perfusion. (Microscopic drops D'', spaced away from edge 46, are, in contrast, acceptable, and indeed can be seen using the invention under certain conditions. Such acceptable, microscopic drops do not exceed about 0.2 $\mu$l volume.)

The extent to which drops of liquid L' locate above line 50 rather than at the line is a function of the surface tension of the liquid, the surface energetics of surface 42, and most especially, the rate of withdrawal of the probe. The slower the withdrawal rate, the more likely it is that liquid L' will locate above line 50.

There is no basic limit on how slowly the probe and container are to be withdrawn from the liquid, FIG. 3. Practical considerations dictate, of course, the most rapid rate that can be tolerated. Preferably, for best results the rate does not exceed about 4.0 cm/sec, unless surface 42 is treated with a surfactant as described hereinafter.

The success of the portion 34 in drawing sheath S away from portion 32 is believed to be due to the increased rate of increase in surface area of the cone fragment that comprises portion 34. Such increased rate of increasing surface area is reflected in the increased rate of increasing effective circumferences for that portion. That is, liquid on this portion "sees" an ever-increasing surface area as it moves a greater distance away from orifice 40 beyond line 50 (axis "x", FIG. 2.) For a given amount of liquid volume, an increasing supportive surface area means an increase in the radius of curvature of the liquid meniscus traveling on this portion. Conversely, the portion of the liquid that is further down on portion 34 or even below line 50 is presented with a reduced supportive surface area. Such liquid portion has a decreased radius of curvature in its meniscus. Liquid having two different radii of curvature in its menisci will preferentially travel towards the meniscus of greatest curvature. Thus, in accordance with this invention, the liquid tends to ride up the exterior surface of cone portion 34 because the surface area of portion 34 gradually increases with distance from platform 38.

It will be appreciated that the distance $x_1$, FIG. 2, controls the effectiveness of intersection line 50 as a locus of liquid collection. If line 50 is too close to orifice 40, drops of liquid L' will still interfere with the dispensing. If it is located too far from the orifice, drops will coalesce between it and the orifice and its ability to attract all or most of the liquid remaining on exterior surface 42 will be diminished. Preferably therefore, distance $x_l$ is between about 0.02 cm and about 0.5 cm. The optimum distance depends partly on the liquid to be dispensed and partly on the contact angle the adjacent exterior surface portion makes with the liquid. For blood serum, distance $x_1$ is most preferably about 2 mm.

During or subsequent to the dispensing of a first quantity, as in FIG. 1, it is important that liquid should not perfuse up around edge 46 from the platform to form one or more drops D, FIG. 5. To this end, it is preferred that edge 46 have a radius of curvature no larger than about 0.02 cm.

The manner in which the partial vacuum and partial pressure are generated within probe 12 for aspiration and dispensing, respectively, is not part of this invention. Rather, these are conventional features available from conventional equipment and procedures. The quantity dispensed onto test element E is in a stream form or in the form of a drop pendant from platform 38 that is subsequently touched off onto element E. A variety of dispensed volume and a variety of forms of test element E are useful. Highly preferred examples of elements E are described in U.S. Pat. No. 3,992,158.

In accordance with another aspect of the invention, it has been found that the remaining liquid most effectively locates itself at or above line 50, FIGS. 1 and 2, if that liquid is broken up into a plurality of beaded drops rather than a single sheath of liquid. An integral sheath of liquid is undesirable because the quantity involved tends to respond to gravity by falling to the vicinity of platform 38. As is well known, to break up a sheath it is necessary that the contact angle of the liquid be increased, that is, the exterior surface must be rendered more hydrophobic in the case of water-based liquids. Accordingly, surface 42 in at least the vicinity of portions 34 and 36 is preferably given an appropriate treatment to render it more hydrophobic than the other portions of that exterior surface. Preferably, this is accomplished by coating portions 34 and 36 of surface 42 with a surfactant. Any conventional surfactant can be used, for example, a wax such as paraffin, or FC-432 TM surfactant, a fluorocarbon surfactant available from 3M.

When surface portion 42 is treated, as with a surfactant, to be more hydrophobic, nozzle 30 can be withdrawn from the main body of liquid at a rate greater than the 4.0 cm/sec rate noted above. Withdrawal rates of up to 10.0 cm/sec have been found to be useful in such cases.

A further advantage of a hydrophobic surface portion 42 is that less, although some, liquid remains behind in the first place.

To insure that container 10 is disposable, it is also preferably free of complicated expensive parts such as valves and the like.

In the embodiment of FIGS. 6–8, the liquid attracting means, while still providing an increasing surface area and a zone of increasing effective circumferences, is not an entire cone portion. Parts similar to those previously described bear the same reference numerals to which the distinguishing suffix "a" has been added. Thus, container **10*a* comprises a wall 14*a*, FIG. 8, forming a compartment 20*a* terminating in a nozzle 30*a* having an orifice 40*a*, as in the previous embodiment. However, the liquid attraction means comprise a plurality of ribs 70 extending or raised from cylindrical nozzle potion 36*a* at an angle $\Delta\alpha_a$, corresponding to $\Delta\alpha_1$ of the previous embodiment. The ribs can extend to any portion of container 10*a* above the nozzle. Any number of such ribs greater than or equal to two can be used, preferably equally spaced around the circumference of portion 36*a*. Intersection line 50*a* so created is again located a distance $x_1$, FIG. 8**, that is within the range noted above.

In the embodiment of FIG. 9, the platform **38*b* is tilted inwardly to create an angle $\beta$ that is less than 90° with respect to the exterior surface of cylindrically-shaped nozzle portion 36*b*. The advantages of this embodiment are that the liquid is induced to fully fill orifice 40 and fully wet the platform, without falling prematurely. Particularly this is important when using surfactants, as the platform tends to become less wettable. A further advantage is that a sharper edge 46*b* is formed and therefore a greater barrier is provided to undesirable perfusion up the exterior surface of portion 36*b*** by dispensed liquid. For example, $\beta$ can be about 30°.

Yet another alternative embodiment, not shown, features the elimination altogether of platform 38, whereby interior surface 54, FIG. 2, meets exterior surface 42 to form edge 42 that provides the sole support for the drop.

By comparison, a device wherein $\Delta\alpha_1$ is sufficient to provide angle $\alpha'$ with a value of 90°, provides an unsatisfactory nozzle, FIG. 10. Here, angle $\alpha$ for portion 36 is 0° as in the embodiments described above. Distance $x_1$ remains the same. However, $\Delta\alpha_1$ equals 90°. The result is the formation of a continuous shoulder 100 that is generally perpendicular to axis 15. When such a nozzle is used, the tendency is for the liquid remaining on the surface to form a large drop D'' seated on shoulder 100 and encompassing nozzle portion 36. Accurate dispensing is not possible unless drop D'' is removed by wiping.

A wide variety of materials has been found to be useful in constructing the container of the invention. Preferably, the material is plastic, such as ABS plastic, polypropylene, polystyrene, polyethylene, or mixtures of plastics. The container can be molded, machined or otherwise formed from such materials.

The invention has been described in detail with particular reference to preferred embodiments thereof, but it will be understood that variations and modifications can be effected within the spirit and scope of the invention.

What is claimed is:

1. A nozzle for sequentially aspirating and dispensing liquid in response, first, to a partial vacuum, and then to a partial pressure, said nozzle comprising a liquid-confining wall extending about a longitudinal axis and terminating in a liquid-dispensing orifice, said wall further including (a) an interior surface, (b) an exterior surface having a portion adjacent to said orifice that is adapted to be immersed into a source of the liquid during aspiration, and (c) means at predetermined loci for attracting liquid remaining on said adjacent exterior surface portion after aspiration, said loci being spaced from said orifice a distance that is effective to prevent liquid remaining on said exterior surface from interfering with the dispensing of the liquid.

2. A nozzle as defined in claim 1, wherein said liquid-attracting means includes a zone of increasing effective circumference on said adjacent surface portion spaced said predetermined distance from said orifice, said effective circumference increasing with increasing distance from said orifice, the rate of increase in the circumference of said zone being significantly greater than any rate of increase present in the circumference of said surface portion located between said orifice and said zone.

3. A nozzle as defined in claim 2, wherein said zone is a portion of a cone.

4. A nozzle as defined in claim 1, wherein said adjacent exterior surface portion extends from said orifice at a first, non-negative angle to said axis, and wherein said liquid-attracting means includes, at said distance, a portion of said exterior surface extending at a second angle to said axis greater than said first angle, the difference between said first and second angles being between about 5° and about 60°.

5. A nozzle as defined in claim 4, wherein said first angle is about 0°.

6. A nozzle as defined in claim 1, wherein said attracting means comprise raised portions on said exterior surface at said loci, said raised portions having surfaces angled with respect to said adjacent exterior surface portion by an amount, measured in an axial cross-section through said nozzle, of between about 5° and about 60°.

7. A nozzle as defined in claim 6, wherein said raised portions comprise ribs disposed about said axis.

8. A nozzle as defined in claim 1, wherein at least said adjacent surface portion has a contact angle between it and the liquid remaining on said surface portion that is increased over said contact angle for the portions of said exterior surface not adjacent to said orifice.

9. A nozzle as defined in claim 1, wherein at least said adjacent surface portion includes a surfactant.

10. A nozzle as defined in claim 1, wherein said distance is between about 0.02 cm and about 0.5 cm.

11. A nozzle as defined in claim 1, wherein said orifice includes a platform surface forming an included angle with said adjacent exterior surface portion that is less than 90°.

12. A container for aspirating, storing and dispensing liquid, the container comprising a compartment having a storage capacity for the total liquid to be aspirated and dispensed, and a nozzle in fluid communication with said compartment and comprising a liquid-confining wall wrapped around a longitudinal axis and terminating in a liquid-dispensing orifice, said wall further including (a) an interior surface, (b) an exterior surface having a portion adjacent to said orifice that is adapted to be immersed into a source of the liquid during aspiration, and (c) means at predetermined loci for attracting liquid remaining on said adjacent exterior surface portion after aspiration, said loci being spaced from said orifice a distance that is between about 0.02 cm and about 0.5 cm, whereby liquid remaining on said exterior surface is attracted to said loci away from said orifice and does not interfere with the dispensing of the aspirated liquid.

13. A container as defined in claim 12, wherein said liquid-attracting means includes a zone of increasing effective circumference on said adjacent surface portion spaced said distance from said aperture, said effective circumference increasing with increasing distance from said orifice, the rate of increase in the circumference of said zone being significantly greater than any rate of increase present in the circumference of said surface portion located between said orifice and said zone.

14. A container as defined in claim 12, wherein said adjacent exterior surface portion extends from said orifice at a non-negative angle to said axis, and wherein said liquid-attracting means includes, at said distance, a portion of said exterior surface extending at a second angle to said axis greater than said first angle, the difference between said first and second angles being between about 5° and about 60°.

15. A container as defined in claim 12, wherein said attracting means comprise raised portions on said exterior surface at said loci, said raised portions having surfaces angled with respect to said adjacent exterior surface portion by an amount, measured in an axial cross-section through said nozzle, of between about 5° and about 60°.

16. A container as defined in claim 12, wherein at least said adjacent surface portion has a contact angle between it and the liquid remaining on said surface portion that is increased over said contact angle for the portions of said exterior surface not adjacent to said orifice.

17. A container as defined in claim 12, wherein at least said adjacent surface portion includes a surfactant.

18. A container as defined in claim 12, wherein said orifice includes a platform surface forming an included angle with said adjacent exterior surface portion that is less than 90°.

* * * * *